United States Patent [19]

Ladislav et al.

[11] 4,157,290

[45] Jun. 5, 1979

[54] COATING ARRANGEMENT

[75] Inventors: Koydl Ladislav; Mielsch Götz, both of Munich, Fed. Rep. of Germany

[73] Assignee: Maschinenfabrik Augsburg-Nurnberg Aktiengesellschaft, Fed. Rep. of Germany

[21] Appl. No.: 937,864

[22] Filed: Aug. 29, 1978

[30] Foreign Application Priority Data

Aug. 29, 1977 [DE] Fed. Rep. of Germany ..... 2738922

[51] Int. Cl.[2] ..... C25C 7/00

[52] U.S. Cl. ..... 204/207; 204/206; 204/208; 204/227

[58] Field of Search ..... 204/206, 207, 208, 227

[56] References Cited

U.S. PATENT DOCUMENTS

| | | | |
|---|---|---|---|
| 3,616,426 | 10/1971 | Nakao et al. | 204/207 |
| 3,622,470 | 11/1971 | Gowman | 204/207 X |
| 3,852,170 | 12/1974 | Angelini | 204/207 X |
| 3,871,982 | 3/1975 | Idstein | 204/207 |

*Primary Examiner*—Arthur C. Prescott

*Attorney, Agent, or Firm*—Craig and Antonelli

[57] ABSTRACT

A galvanic coating apparatus for coating of relatively long objects. The coating apparatus is provided with a trough for accommodating a bath liquid with the trough including two opposite end walls, each of which are provided with an opening for permitting the long object to pass therethrough. The trough is disposed in a larger container which is also provided with two openings for accommodating the object to be coated. The openings in the trough and the container are arranged such that they are in alignment when the trough is disposed in the container.

8 Claims, 2 Drawing Figures

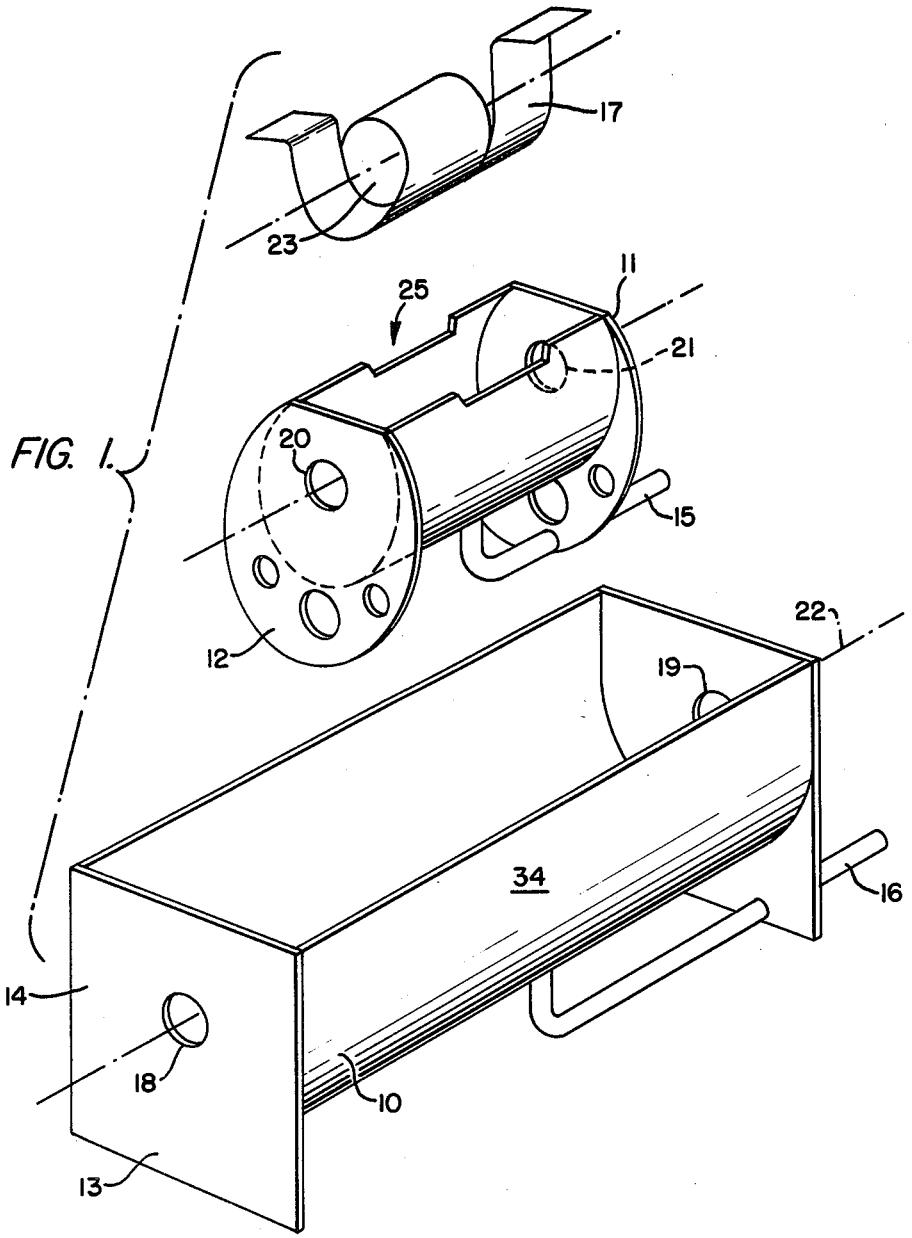
FIG. 2.
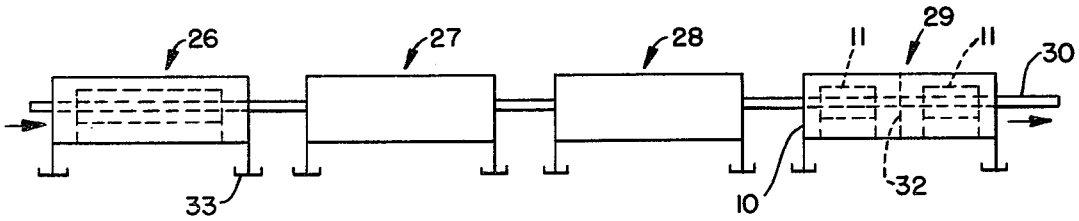

COATING ARRANGEMENT

The present invention relates to a coating arrangement and, more particularly, to a galvanic coating arrangement for coating relatively long objects, which arrangement includes a trough or container for accommodating a bath fluid.

To effect glavanic coating, it has been proposed to provide a container or, with relatively larger objects, a so-called trough, filled with an electrolyte. The object to be coated is submerged in the electrolyte and connected to an electrical circuit as a cathode. A disadvantage of this proposed coating construction resides in the fact that the container or trough must at least have the dimensions of the object to be coated.

The aim underlying the present invention essentially resides in providing a coating apparatus for coating objects having a length which is larger than the cross-sectional dimensions of the object, with the length of the container or trough being independent of the length of the object to be coated.

According to advantageous features of the present invention, a container or trough is provided which includes openings provided flush in two opposite walls with the openings accommodating the object to be coated. The trough or container is disposed in a larger trough or container which is also provided with two openings in opposite end walls thereof, which two openings align with the openings in the first trough when the first trough is arranged in the second trough or container.

By virtue of the construction of a coating apparatus in accordance with the features of the present invention, it is possible to, for example, process pipes in a relatively small container regardless of the length of such pipes, thereby resulting in a considerable savings with respect to dimensions of the trough or container since such dimensions are no longer dependent upon the length of the object to be coated. Moreover, by processing the relatively long objects in relatively small containers or troughs, a considerable reduction of the required bath volume is also realized.

In accordance with the present invention, an object passes through the aligned openings in the two troughs or containers and is pulled through the electrolyte. Any electrolyte which escapes through slot openings in the first trough or container drips into the second trough or container and may be simultaneously and continuously recycled to the top trough by an appropriate feed. By such an arrangement, a careful sealing of the first trough or container is unnecessary, thereby simplifying the manufacturing of the trough so as to provide additional cost reductions.

According to the present invention, the second trough, may advantageously function as a supply tank for the electrolytic solution with the electrolytic solution being recycled back into the bath formed in the first trough in dependence upon the leak rate.

In situations wherein multiple coating is required as, for example, in black chrome plating of absorber tubes for solar collectors wherein the absorber tubes are initially nickel-plated to make them accept a radiation-absorbent chromium layer, according to a further feature of the present invention, a plurality of dual-trough electrolytic cells may be connected in series so that an object to be coated can be guided in one pass through a series of baths.

In situations wherein a particular coating is brittle or wherein a coated surface must not be damaged, in order to avoid transporting such coated objects, according to yet another feature of the present invention, a series of the electrolytic cells may be divided into small-sized cells and combined with necessary assemblies so as to form a portable unit. By virtue of such an arrangement, the coating process could be performed at any given location. This is particularly advantageous and favorable when installing "parabolic" solar collector arrays, for such arrays utilize long chrome-plated absorber tubes which could then be chrome-plated directly on the location where the solar array is to be erected, thereby eliminating the need for careful packing of the absorber tubes to protect the relatively brittle chromium coating during shipment.

Advantageously, according to the present invention, rinsing cells as well as de-greasing cells, pickling cells and other cells may be interposed between the dual-troughed electrolytic cells or the divided electrolytic cells so that the total process, including the pre-treatment and intermediate treatment required for galvanic process, as well as for single and multiple coating, reduces the cost of the process to a significant degree by comparison with previous methods of processing.

Moreover, with a coating apparatus constructed in accordance with the present invention, the heretofore necessary devices for gripping the object and submerging the same into a bath, subsequently lifting the object out of the bath, transporting the object to adjacent cells, and subsequently dipping the transported object in the adjacent cells, are eliminated.

Accordingly, it is an object of the present invention to provide a coating apparatus which avoids, by simple means, drawbacks and disadvantages encountered in the prior art.

Another object of the present invention resides in providing a coating apparatus wherein the dimensions of the trough or container are not dependent upon the lengths of the objects to be coated.

A further object of the present invention resides in providing a coating apparatus wherein a multiple coating of an object is greatly facilitated.

Yet another object of the present invention resides in providing a coating apparatus which significantly reduces the overall costs of a coating process.

Still a further object of the present invention resides in providing a coating apparatus which is simple in construction and, therefore, inexpensive to manufacture.

An additional object of the present invention resides in providing a coating apparatus which functions reliably under all operating conditions.

These and other objects, features and advantages of the present invention will become more apparent from the following description when taken in connection with the accompanying drawings which show, for the purpose of illustration only, one embodiment in accordance with the present invention, and wherein:

FIG. 1 is an exploded perspective view of a coating apparatus in accordance with the present invention; and FIG. 2 is a schematic representation of a series connection of a plurality of coating apparatus such as illustrated in FIG. 1.

Referring now to the drawings wherein like reference numerals are used in both views to designate like parts and, more particularly, to FIG. 1, a coating trough or container 11 is adapted to be installed or mounted in a larger collecting trough or container 10 with the trough 11 being provided with downwardly projecting end walls 12. The trough 10 is mounted on plates 13 which simultaneously form the end walls of the trough or container 10. Conduits or pipes 15, 16 are connected at the deepest point of the respective containers 11, 10. The conduits or pipes 15, 16 may be connected to a suitable pump (not shown) and/or a fluid supply (not shown) so that the respective pipes serve to both fill and empty the troughs 10, 11. A cylindrical anode 17 is suspended in the coating trough 11.

The end walls 12 of the container or trough 11 are provided with aligned openings 20, 21 and the end walls 13 of the container or trough 12 are also provided with aligned openings 18, 19. The openings 18, 19, 20, 21 are adapted to receive the object to be coated. When the containers or troughs 10, 11 are assembled, the openings 18, 19, 20, 21 are in alignment and are concentric with respect to a longitudinal axis 22 and coaxial with respect to the opening 23 of the cylindrical anode 17.

As shown most clearly in FIG. 2, a long object such as, for example, a pipe 30, passes through the openings 18, 19, 20, 21 with the pipe 30 being submerged lengthwise in the bath contained in the coating trough or container 11. If an electrolytic solution is provided in the trough or container 11, the pipe 30 is coated by supplying an electric current to the coating apparatus in a ccoventional manner.

In use, the appropriate fluid is supplied to the trough 11 so as to completely fill the same. A portion of the fluid continuously flows into the trough or container 10 through a space which results between the edges of the openings 20, 21 and the outer peripheral surface of the object being coated. To compensate for the leak rate of fluid, additional fluid may be continuously added through the pipe 15 so that the fluid flows completely around that portion of the object which is accommodated in the trough or container 11. The bath may be topped by adding fresh medium as is necessary, for example, when rinsing the object.

Depressions generally designated by the reference numeral 25 may be provided along an upper edge of the trough or container 11 so as to allow for directed flow of the fluid from above. The fluid which runs off into the lower trough 10 is carried away by the pipe or conduit 16. In case of an electrolyte bath, the liquid from the container 10 may be utilized to refresh the supply of electrolytic solution in the trough or container 11.

As shown in FIG. 2, individual cells generally designated by the reference numerals 26, 27, 28 and 29 may be connected or arranged in series with each of the cells being filled with an appropriate medium for, for example, de-greasing, repeated rinsing and coating in one sequence. The long object such as the pipe 30 is guided at a predetermined speed through aligned openings in all of the cells and is processed accordingly in each section in sequence.

Additionally, as indicated in the cell 29, at least one partition 32 may be provided in the trough or container 10 so that a plurality of troughs or containers 11 can be disposed in a single container or trough 10. Such partitioning of a cell would not be required for a rinsing operation.

A simplification from the manufacturing standpoint can be achieved by disposing the respective plates 13 in pans 33 which, for example, may be constructed of a plastic material with the pans serving to catch any leaks from glued or welded seams between end walls 14 and a housing 34 of the container or trough 10. By virtue of this arrangement, a great degree of care need not be exercised in the manufacturing of the trough or container 10.

While we have shown and described only one embodiment in accordance with the present invention, it is understood that the same is not limited thereto, but is susceptible of numerous changes and modifications as known to a person having ordinary skill in the art, and we therefor do not wish to be restricted to the details shown and described herein, but intend to cover all such changes and modifications as are encompassed by the scope of the appended claims.

We claim:

1. A galvanic coating apparatus for coating relatively long objects, characterized in that a trough means is provided for accommodating a liquid bath, said trough means including two oppositely disposed end walls, each of said end walls is provided with an opening therein, a container means for accommodating said trough means, said container means included oppositely disposed end walls with each of said end walls of said container means being provided with openings therein, the openings in the end walls of the trough means and the openings in the end walls of the container means being arranged so as to be in alignment when the trough means is disposed in the container means so that an object to be coated is permitted to pass through the end walls of the trough means and container means.

2. An apparatus according to claim 1, characterized in that the container means is constructed as a supply container for supplying the liquid bath to the trough means.

3. An apparatus according to one of claims 1 or 2, characterized in that a plurality of container means are provided, each of said container means accommodating at least one of said trough means, and in that said container means are arranged in series such that the openings in the respective end walls of the trough means and container means lie in a straight line forming a longitudinal central axis of the coating apparatus.

4. An apparatus according to claim 3, characterized in that at least one of the plurality of container means includes a rinsing bath.

5. An apparatus according to claim 4, characterized in that at least another one of said plurality of container means includes a de-greasing bath.

6. An apparatus according to claim 5, characterized in that means are provided for connecting said plurality of container means so as to form a portable unit.

7. An apparatus according to claim 3, characterized in that each of said plurality of container means accommodates an appropriate liquid bath so as to effect a complete coating process in the coating apparatus.

8. An apparatus according to claim 1, characterized in that a hollow cylindrical anode is accommodated in said trough means, and in that said openings in the respective end walls of the trough means and the container means are coaxial with respect to a longitudinal axis of the cylindrical anode.

* * * * *